US007793804B2

(12) United States Patent
McGiveron

(10) Patent No.: US 7,793,804 B2
(45) Date of Patent: Sep. 14, 2010

(54) RESERVOIR PUMP

(75) Inventor: Jeffrey C. McGiveron, Basom, NY (US)

(73) Assignee: Chapin Manufacturing, Inc., Batavia, NY (US)

( * ) Notice: Subject to any disclaimer, the term of this patent is extended or adjusted under 35 U.S.C. 154(b) by 516 days.

(21) Appl. No.: 11/788,139

(22) Filed: Apr. 19, 2007

(65) Prior Publication Data

US 2007/0246487 A1 Oct. 25, 2007

Related U.S. Application Data

(60) Provisional application No. 60/793,551, filed on Apr. 20, 2006.

(51) Int. Cl.
*B67D 5/40* (2006.01)

(52) U.S. Cl. ..... 222/385; 222/401; 222/373; 222/137

(58) Field of Classification Search ..... 222/341, 222/383.1, 321.7, 321.9, 340, 321.8, 321.2, 222/380, 137, 258, 385, 332, 387, 468, 401, 222/373

See application file for complete search history.

(56) References Cited

U.S. PATENT DOCUMENTS 2,220,467 A * 11/1940 Tamminga ..... 222/195
2,575,508 A 11/1951 Balletto
2,594,223 A * 4/1952 Santarelli ..... 222/385
3,428,255 A 2/1969 Ballu
4,154,374 A * 5/1979 Kirk, Jr. ..... 222/321.2
4,690,331 A 9/1987 Luchsinger
5,335,853 A 8/1994 Wirz
5,636,791 A 6/1997 Leer
5,755,361 A * 5/1998 Restive et al. ..... 222/209
5,816,454 A 10/1998 Odessa
5,857,618 A 1/1999 Restive
5,984,199 A 11/1999 Restive
6,089,414 A * 7/2000 Shanklin et al. ..... 222/321.7
6,264,070 B1 * 7/2001 McGiveron et al. ..... 222/385
6,296,154 B1 * 10/2001 Shanklin et al. ..... 222/321.9

(Continued)

*Primary Examiner*—Kevin P Shaver
*Assistant Examiner*—Donnell Long
(74) *Attorney, Agent, or Firm*—Kenneth J. Lukacher; Martin Lukacher

(57) ABSTRACT

A reservoir pump in which liquid supplied from a container in which the pump is installed enters a pressure chamber with respect to which a piston reciprocates in suction and compression strokes. The chamber communicates with a reservoir, (the supply) so that liquid is supplied into the chamber in the suction stroke of the piston and transferred under pressure into the reservoir during the compression stroke. The chamber is open to supply and to the reservoir via one-way valves which open during the suction and compression strokes, respectively. A passage providing an orifice with a cross section much smaller than the cross section of the opening into the chamber, which communicates the chamber with the supply, is open via another one-way valve during the suction stroke. Air enters through the passageway. This air is compressed during the compression stroke. Sufficient compressed air is delivered together with the liquid into the reservoir so as to accumulate sufficient pressure to pressurize the fluid when released from the reservoir for spraying thereby counteracting any build up of remnant liquid in the pressure chamber, which would decrease the volume of air in the chamber on successive strokes and prevent complete discharge of the liquid from the chamber into the reservoir and from the reservoir to allow pressurized liquid to be sprayed.

9 Claims, 1 Drawing Sheet

U.S. PATENT DOCUMENTS 6,953,133 B2 * 10/2005 Englhard et al. ..... 222/385
7,093,624 B2 * 8/2006 Chen ..... 141/65
7,581,662 B2 * 9/2009 Powell ..... 222/401

* cited by examiner

RESERVOIR PUMP

Priority is claimed to U.S. Provisional Patent Application Ser. No. 60/793,551, filed Apr. 20, 2006.

DESCRIPTION

The present invention relates to a reservoir pump which is adapted to be used in a container having walls which cannot support sufficient pressurization in the container to enable spraying of liquids under pressure directly out of the container, and provides a reservoir pump which an improvement over the pump described in U.S. Pat. No. 6,264,070, issued Jul. 24, 2001 to Jeffrey C. McGiveron et al.

Reservoir pumps, such as shown in the McGiveron et al. patent, are adversely affected by the accumulation of liquid during each pumping cycle as represented by the suction and compression stroke of the piston, in that the fluid build up reduces the volume of air which is compressed in each cycle and is available for compression. Insufficient pressurization of the air precludes the accumulation of sufficient pressure for discharge of desired amounts of liquid during spraying. The reduction of the volume of air by the increase in the volume of incompressible liquid may be referred to as a "hydrolock". The present invention overcomes the hydrolock problem by introducing additional air during the suction part of the cycle so that the volume of air available for compression is maintained and the pressure is sufficient to transfer the liquid into the compression chamber during each compression cycle and accumulate sufficient liquid in the reservoir for release as during spraying operations from the reservoir without hydrolocking due to remnant liquid.

It is a principal advantage of the invention to enable the use of reservoir pumps which do not have accumulators such as elastic bladders to provide elastically assisted ejection of liquid, thereby avoiding the adverse reliability, and requirement for replacement, of such elastic bladders as is in the case in design such as shown in Restive, U.S. Pat. No. 5,984,199, issued Nov. 16, 1999. The Restive patent and other patents on reservoir pumps as well as their application in various spraying apparatus will be found in the references cited in the above reference McGiveron et al. patent.

The foregoing and other objects, advantages and features of the present invention will become more apparent from a reading of the following description in connection with the accompanying drawings in which.

Figure 1:
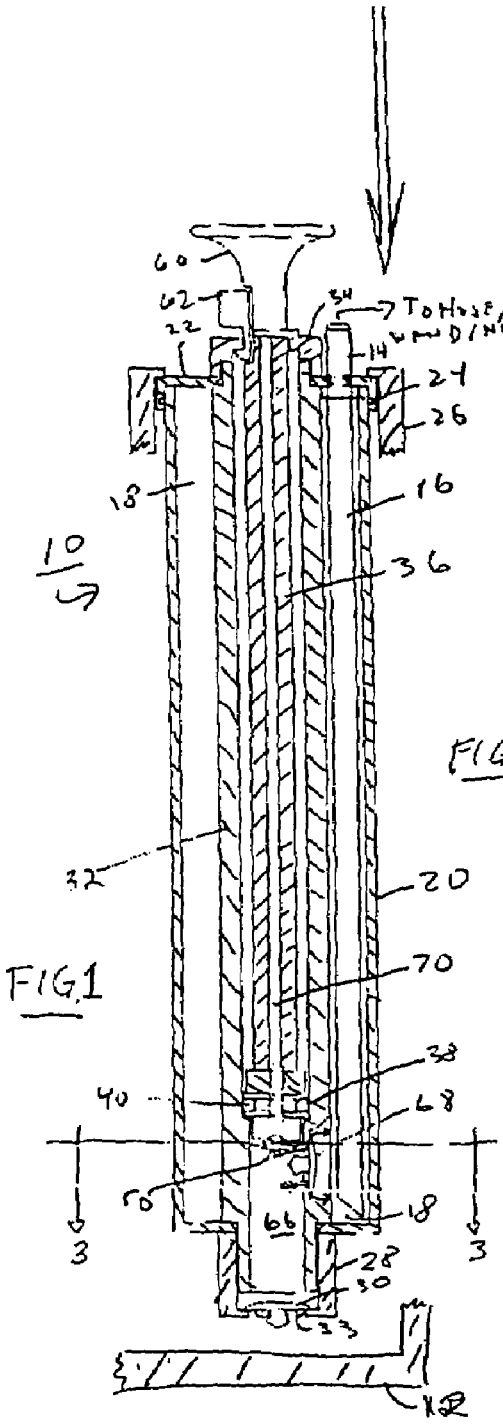
FIG. 1 is a sectional view of a reservoir pump embodying the invention shown installed in a container providing a supply of fluid to be pumped by the reservoir pump, the pump being shown at the bottom of the compression stroke of the piston thereof.

The design of the reservoir pump illustrated in the figures is similar to the design of the reservoir pump in the above referenced McGiveron et al. U.S. Pat. No. 6,264,070, which is incorporated by reference, as though set forth fully at length herein.

The reservoir pump 10 is shown installed in a container 12 having a supply of the liquid to be pumped. This container may have a premixed solution of insecticide or herbicide, which is the liquid material to be pumped by the reservoir pump. It will be appreciated that the reservoir pump may be removably received in the container and replaced in other containers. The solutions which are pumped by the reservoir pump are often referred to as being ready to use since they are premixed in their containers. The containers may, however, have facilities for refilling with quantities of other materials which it is desired to spray. The reservoir pump 10 is connected via hose to a coupling shown at 14 at the end of a discharge tube 16 which provides an outlet for the reservoir 18 of the pump 10. The reservoir 18 has a cylindrical shell 20 closed by a cap 22 having a lip with an o-ring seal 24. The reservoir may be held in a collar 26 of the container having sufficient elasticity and friction to hold the pump in place when snapped into place under a lip of the collar 26. Alternatively screw in connections may be used as shown in the McGiveron et al. patent.

The bottom of the reservoir shell 20 is closed by a tubular stem 28 in which a one-way valve 30, which may be an elastic check valve, is installed across an opening 33 in the bottom of the stem 28. The inside of the reservoir 18 is defined by a guide tube 32 which is seated on the bottom of the reservoir 18 and within the stem 28. The top of the guide tube is secured by a collar 34.

A piston assembly 36 includes a piston 38 having an o-ring seal 40 which sealingly engages the inner periphery of the guide tube 32.

Figure 4:
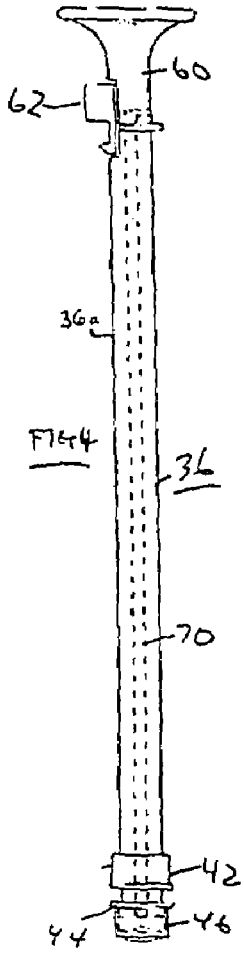
FIG. 4 is a elevational view of the piston assembly used in the pump illustrated in FIGS. 1, 2, and 3.
Figure 5:
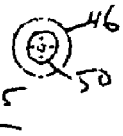
FIG. 5 is a bottom view of the piston assembly shown in FIG. 4.
Figure 3:
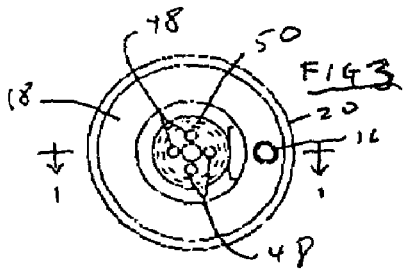
FIG. 3 is a sectional view through the one-way or check valve of the piston, the view being taken along the line 3-3 in FIG. 1, the figure also shows the line 1-1 through the central diameter of the reservoir pump of the sectional view in FIG. 1.

As shown in FIGS. 4 and 5, the piston assembly 36 has a piston rod **36*a* closed by a boss 42. A ring 44 spaced from the bottom of the boss 42 defines a grove for the o-ring 40 and supports a cup 46. The bottom of the cup 46 has four holes 48 which are closed by a one-way valve 50. This valve is similar to the valve 30 and may be an elastic check valve which has a sealing surface over the bottom of the cup 46 which covers the holes 48**.

A handle 60 which may be manually actuated to reciprocate the piston rod **36*a* and the piston 38 is attached to the top of the rod 36*a*. A latch 62 which releases when the knob 60 is pulled upwardly may be connected to the handle 60 and provides a safety feature by latching to the ring 34 on the inside of a lip thereof. This provides an optional safety feature for the pump 10**.

The piston 38 at the head of the piston rod assembly 36 defines the upper end of a pressure chamber 66. This chamber communicates with the reservoir 18 via another one-way valve 68 which may be an elastic check valve similar to the valves 30 and 50.

Figure 2:
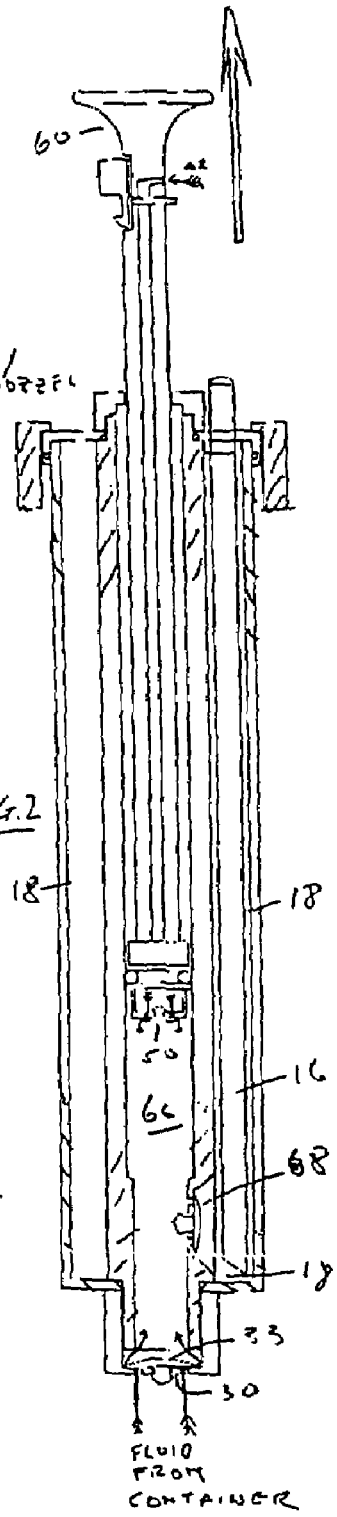
FIG. 2 is a view similar to FIG. 1 where the pump is shown at the top of the suction stroke of the piston thereof.

The improvement provided by the invention is obtained by venting the pressure chamber 66 to the ambient on the suction stroke of the piston 36. In the illustrated embodiment this venting is accomplished by means of a passageway 70 through the piston rod **36*a*. This passageway defines an orifice having a cross section which is much smaller than the opening 33 into the bottom of the pressure chamber 66 from the supply of liquid provided by the container. Preferably, the cross section as represented by the diameter of the opening 70 is less than ten percent (10%) of the cross section defined by the diameter of the opening 33. The venting of the pressure chamber 66 during the suction stroke of the piston 36 is assured by virtue of the one-way valve 50. During the suction stroke the one-way valve 68, communicating the pressure chamber 66 with the reservoir 18 is closed by virtue of the position of the elastic seal of the check valve 68. The liquid supply in the container 12 enters through the check valve 30** via the opening 33, as shown in FIG. 2. The check valve 50, which closes the passageway 70, is open during the suction stroke, also as shown in FIG. 2. When the pressure chamber 66 is vented, the additional air that was provided via valve 50 is available for compression during the compression stroke, as shown in FIG. 1. The air and the liquid, which during the suction part of the cycle entered into the pressure chamber 66, is ejected through the one-way valve 68 into the reservoir 18. The air is compressed in reservoir 18. Therefore, the pressure in the reservoir is maintained. Because of the increased air volume, and therefore the consistent pressurized air in the pressure chamber 66, substantially all of the fluid in the pressure chamber is transferred into the reservoir 18. Build up of fluid and hydrolock is thereby substantially avoided. Also, the liquid in the reservoir is maintained under constant pressure which builds up during each pumping cycle so that sufficient pressure is obtained for a prolonged spraying time or several spraying pulses when the nozzle at the end of the hose connected to the coupling 14 is valved open in the conventional way.

Variations and modifications in the herein described reservoir pump, within the scope of the invention, will undoubtedly become apparent to those skilled in the art. Accordingly the foregoing description should be taken as illustrative and not in a limiting sense.

What is claimed is:

1. A pump for developing pressure for spraying liquid material via said pump, said pump comprising a pressure chamber with respect to which a piston reciprocates in compression and suction strokes, a pressurizable reservoir for said liquid, one way valves communicating said chamber and a supply of said liquid material on the suction stroke, and said reservoir and said chamber on said compression stroke, said reservoir receiving from said chamber and retaining said liquid material under pressure for spraying from an outlet from said reservoir, and a passage for venting said chamber from outside air via another one-way valve on an end of said piston at said chamber exclusively on said suction stroke and closing said passage during said compression stroke, wherein the air and liquid material in the chamber maintains the pressure developed in said chamber on successive compression strokes and also maintains pressure in said reservoir as said reservoir fills with air and liquid material from the pressure chamber on successive compression strokes.

2. The pump according to claim 1 wherein said passageway is via said piston.

3. The pump according to claim 1 wherein said another one-way valve is on an end of said piston facing said chamber.

4. The pump according to claim 2 wherein said passageway defines an orifice smaller than the opening providing communication between said chamber and said supply.

5. The pump according to claim 2 wherein the orifice defined by said passageway is smaller than an opening which communicates that said pressure chamber and said reservoir.

6. The pump according to claim 4 wherein the orifice defined by said passageway is smaller than an opening which communicates that said pressure chamber and said reservoir.

7. The pump according to claim 4 wherein the cross section of said passageway or orifice does not exceed 10 percent of the cross section of the opening communicating said supply and said chamber so as to minimize reduction of volume of liquid material pumped into said chamber on said suction stroke than would be the case in the absence of said passageway or orifice.

8. The pump according to claim 5 wherein the cross section of said passageway or orifice does not exceed 10 percent of the cross section of the opening communicating said supply and said chamber so as to minimize reduction of volume of liquid material pumped into said chamber on said suction stroke than would be the case in the absence of said passageway or orifice.

9. The pump of claim 1 wherein said chamber has a volume less than the volume of said reservoir.

* * * * *